US010067520B2

(12) United States Patent
Iwata et al.

(10) Patent No.: US 10,067,520 B2
(45) Date of Patent: Sep. 4, 2018

(54) LINEAR POWER SUPPLY CIRCUIT

(71) Applicant: Rohm Co., Ltd., Kyoto (JP)

(72) Inventors: Kotaro Iwata, Kyoto (JP); Hiroki Inoue, Kyoto (JP); Zhencheng Jin, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 191 days.

(21) Appl. No.: 15/092,061

(22) Filed: Apr. 6, 2016

(65) Prior Publication Data

US 2016/0299518 A1 Oct. 13, 2016

(30) Foreign Application Priority Data

Apr. 10, 2015 (JP) ..... 2015-080914

(51) Int. Cl.
*G05F 1/30* (2006.01)
*G05F 1/46* (2006.01)
*G05F 1/59* (2006.01)

(52) U.S. Cl.
CPC ..... *G05F 1/468* (2013.01); *G05F 1/59* (2013.01)

(58) Field of Classification Search
CPC ..... G05F 1/30
USPC ..... 323/269–285, 315
See application file for complete search history.

(56) References Cited

U.S. PATENT DOCUMENTS 5,528,127 A * 6/1996 Streit ..... G05F 1/565 323/269
6,911,867 B2 * 6/2005 Tzeng ..... H03F 1/303 330/252
9,362,742 B2 * 6/2016 Kayama ..... H02J 1/00
2005/0110477 A1 * 5/2005 Mauthe ..... G05F 1/465 323/316
2011/0285320 A1 * 11/2011 Kustra ..... H05B 33/0815 315/297
2013/0271098 A1 * 10/2013 Attianese ..... G05F 1/46 323/271

FOREIGN PATENT DOCUMENTS

JP 2010-211721 9/2010

* cited by examiner

*Primary Examiner* — Adolf Berhane
*Assistant Examiner* — Nusrat Quddus
(74) *Attorney, Agent, or Firm* — Fish & Richardson P.C.

(57) ABSTRACT

A linear power supply circuit includes a first output transistor of a P-channel type or pnp type which is connected between an input terminal to which an input voltage is input and an output terminal from which an output voltage is output; a first differential amplifier configured to amplify a difference between the output voltage or a feedback voltage according to the output voltage and a predetermined first reference voltage and output a first amplification voltage; a second differential amplifier configured to amplify a difference between the input voltage or a first monitor voltage according to the input voltage and the output voltage or a second monitor voltage according to the output voltage and output a second amplification voltage; and a first driver configured to generate a control voltage of the first output transistor according to the first amplification voltage and the second amplification voltage.

11 Claims, 12 Drawing Sheets

LINEAR POWER SUPPLY CIRCUIT

CROSS-REFERENCE TO RELATED APPLICATION

This application is based upon and claims the benefit of priority from Japanese Patent Application No. 2015-080914, filed on Apr. 10, 2015, the entire contents of which are incorporated herein by reference.

TECHNICAL FIELD

The present disclosure relates to a linear power supply circuit such as a series regulator, an LDO (Low Drop-Out) regulator or the like.

BACKGROUND

Linear power supply circuits for generating an output voltage Vout from an input voltage Vin by continuously controlling the conductance of an output transistor have been conventionally in wide use.

However, in such conventional linear power supply circuits, it was difficult to achieve stability in transient operation such as an input voltage variation or load current variation in negative feedback control of the linear power supply circuits.

SUMMARY

The present disclosure provides some embodiments of a linear power supply circuit with good transient characteristics.

According to one embodiment of the present disclosure, there is provided a linear power supply circuit including: a first output transistor of a P-channel type or pnp type which is connected between an input terminal to which an input voltage is input and an output terminal from which an output voltage is output; a first differential amplifier configured to amplify a difference between the output voltage or a feedback voltage according to the output voltage and a predetermined first reference voltage and output a first amplification voltage; a second differential amplifier configured to amplify a difference between the input voltage or a first monitor voltage according to the input voltage and the output voltage or a second monitor voltage according to the output voltage and output a second amplification voltage; and a first driver configured to generate a control voltage of the first output transistor according to the first amplification voltage and the second amplification voltage.

The linear power supply circuit may further include: a first voltage divider configured to divide the input voltage according to a first voltage division ratio and generate the first monitor voltage; and a second voltage divider configured to divide the output voltage according to a second voltage division ratio and generate the second monitor voltage.

The first voltage division ratio may be designed to be equal to or lower than the second voltage division ratio.

The first driver may include: a first transistor of a pnp type or P-channel type, which is connected between the input terminal and a control terminal of the first output transistor, the first transistor having a conductance being changed by the first amplification voltage; a second transistor of a pnp type or P-channel type, which is connected between the input terminal and the control terminal of the first output transistor, the second transistor having a conductance being changed by the second amplification voltage; a current source connected between the control terminal of the first output transistor and a ground terminal; and a first resistor connected between the input terminal and the control terminal of the first output transistor.

The linear power supply circuit may further includes: a second output transistor of an N-channel type or npn type which is connected between the input terminal and the output terminal; a third differential amplifier configured to amplify a difference between the output voltage or the feedback voltage and a predetermined second reference voltage higher than the first reference voltage and output a third amplification voltage; and a second driver configured to generate a control voltage of the second output transistor according to the third amplification voltage.

The second driver may include: a third transistor of an N-channel type or npn type, which is connected between a control terminal of the second output transistor and the ground terminal, the third transistor having a conductance being changed by the third amplification voltage; and a second resistor connected between the input terminal and the control terminal of the second output transistor.

According to another embodiment of the present disclosure, there is provided a linear power supply circuit including: a first output transistor of a P-channel type or pnp type which is connected between an input terminal to which an input voltage is input and an output terminal from which an output voltage is output; a second output transistor of an N-channel type or npn type which is connected between the input terminal and the output terminal; a first differential amplifier configured to amplify a difference between the output voltage or a feedback voltage according to the output voltage and a predetermined first reference voltage and output a first amplification voltage; a second differential amplifier configured to amplify a difference between the output voltage or the feedback voltage and a predetermined second reference voltage higher than the first reference voltage and output a second amplification voltage; a first driver configured to generate a control voltage of the first output transistor according to the first amplification voltage; and a second driver configured to generate a control voltage of the second output transistor according to the second amplification voltage.

The first driver may include: a first transistor of a pnp type or P-channel type, which is connected between the input terminal and a control terminal of the first output transistor, the first transistor having a conductance being changed by the first amplification voltage; a current source connected between the control terminal of the first output transistor and a ground terminal; and a first resistor connected between the input terminal and the control terminal of the first output transistor.

The second driver may include: a second transistor of an N-channel type or npn type, which is connected between a control terminal of the second output transistor and the ground terminal, the second transistor having a conductance being changed by the second amplification voltage; and a second resistor connected between the input terminal and the control terminal of the second output transistor.

The linear power supply circuit may further include: a reference voltage generator configured to divide a predetermined reference voltage and generate each of the first reference voltage and the second reference voltage.

DETAILED DESCRIPTION

<Linear Power Supply IC>

Figure 1:
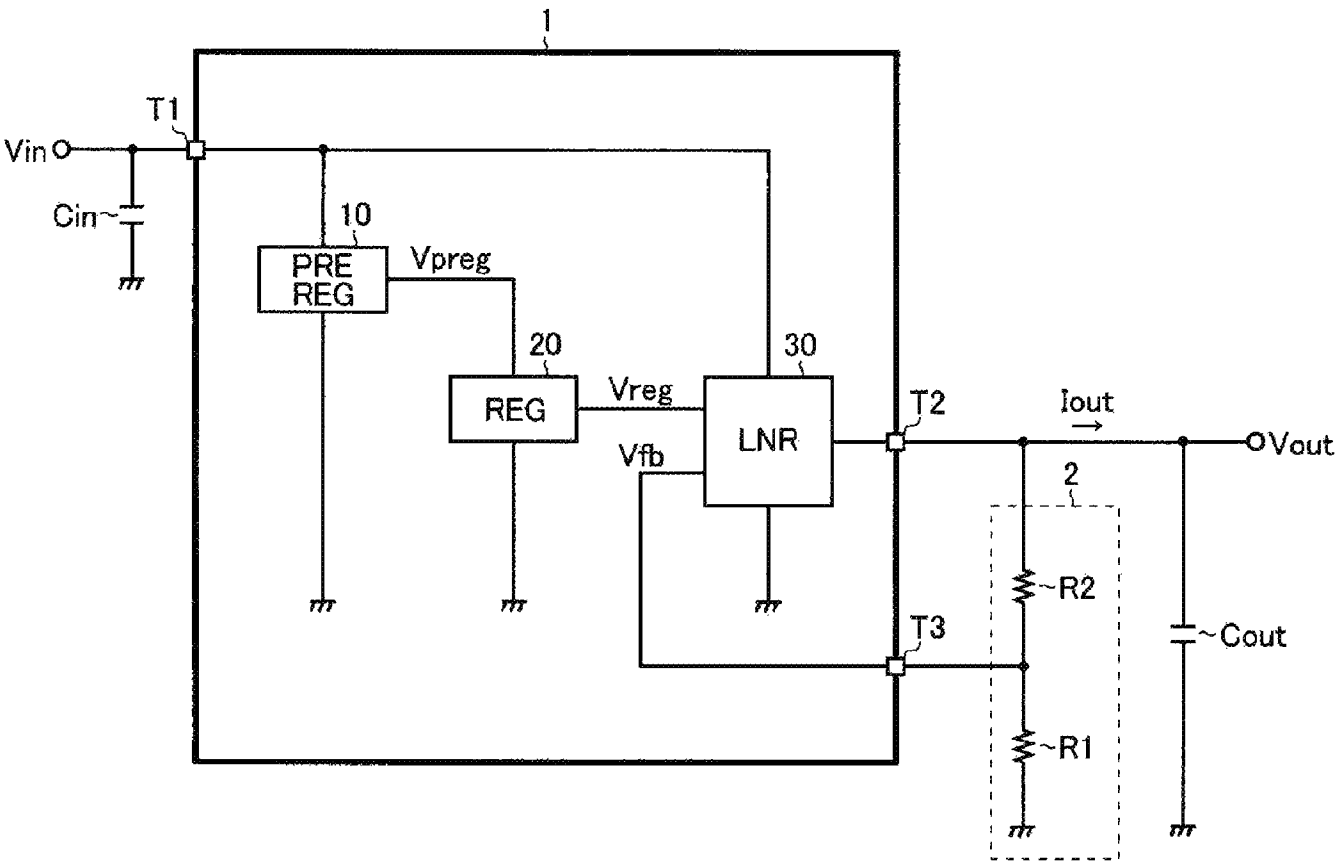
FIG. 1 is a block diagram showing the overall configuration of a linear power supply IC 1.

FIG. 1 is a block diagram showing the overall configuration of a linear power supply IC 1. Referring to this figure, a linear power supply IC 1 includes a pre-regulator circuit 10, a reference voltage generation circuit 20 and a linear power supply circuit 30, which are integrated in one body.

Further, the linear power supply IC 1 also has external terminals T1 to T3 as means for establishing electrical connection with the outside of the IC 1. The external terminal T1 is an input terminal for receiving an input voltage Vin. The external terminal T2 is an output terminal for outputting an output voltage Vout. The external terminal T3 is an input terminal for receiving a feedback voltage Vfb (corresponding to a voltage produced by division of the output voltage Vout).

In the outside of the linear power supply IC 1, a voltage division circuit 2 is connected between the external terminal T2 and a ground terminal. The voltage division circuit 2 includes a resistor R1 and a resistor R2. A first end of the resistor R1 is connected to the ground terminal. A second end of the resistor R1 and a first end of the resistor R2 are connected to the external terminal T3. A second end of the resistor R2 is connected to the external terminal T2. The voltage division circuit 2 outputs the feedback voltage Vfb ($=\{R1/(R1+R2)\}\times Vout$) from a connection node between the resistor R1 and the resistor R2. The resistor R1 and the resistor R2 may be incorporated in the linear power supply IC 1.

Further, in the outside of the linear power IC 1, an input smoothing capacitor Cin is connected between the external terminal T1 and the ground terminal and an output smoothing capacitor Cout is connected between the external terminal T2 and the ground terminal.

The pre-regulator 10 generates a predetermined pre-power supply voltage Vpreg from the input voltage Vin. The pre-regulator 10 is required to implement both of low voltage driving and stable driving with the smallest possible circuit configuration.

The reference voltage source 20 generates a predetermined reference voltage Vreg from the pre-power supply voltage Vpreg. In particular, if a range of variation of the input voltage Vin is wide, it is desirable to generate the reference voltage Vreg from a pre-power supply voltage Vpreg obtained by stabilizing the input voltage Vin to a certain extent, instead of directly generating the reference voltage Vreg from the input voltage Vin. Such a configuration allows a desired reference voltage Vreg to be generated stably irrespective of a variation of the input voltage Vin. However, the reference voltage source 20 is not limited to the configuration for generating the reference voltage Vreg from the pre-power supply voltage Vpreg. In other words, the reference voltage source 20 may employ any circuit configuration as far as it can generate the desired reference voltage Vreg.

The linear power supply circuit 30 is a main regulator for generating a desired output voltage Vout from the input voltage Vin by continuously controlling the conductance of an output transistor (not shown in this figure) connected in series between the external terminal T1 and the external terminal T2. Hereinafter, the internal configuration of the linear power supply circuit 30 will be described in detail.

Linear Power Supply Circuit (First Embodiment)

Figure 2:
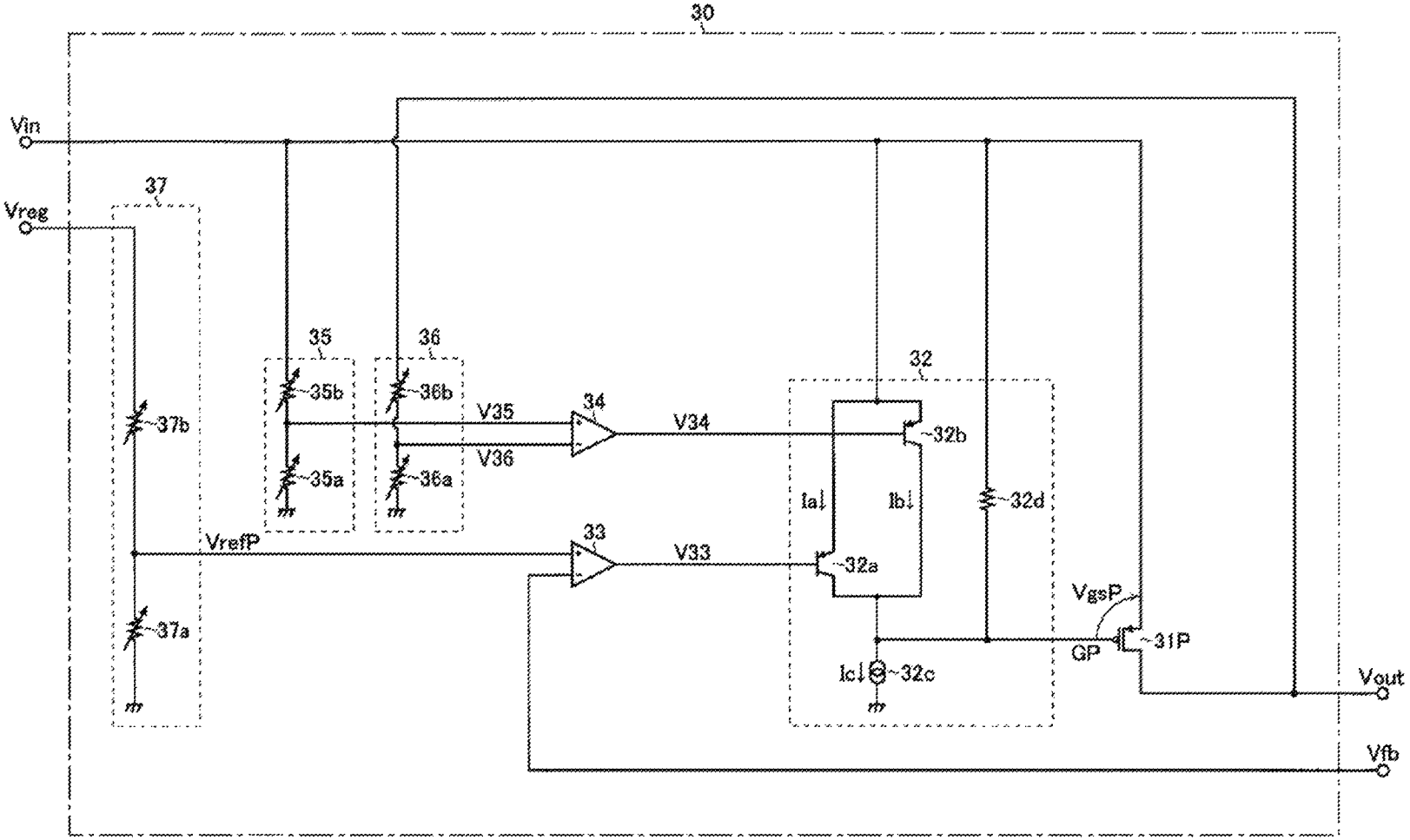
FIG. 2 is a circuit diagram showing a linear power supply circuit 30 according to a first embodiment.

FIG. 2 is a circuit diagram showing a linear power supply circuit 30 according to a first embodiment. The linear power supply circuit 30 of the first embodiment includes a first output transistor 31P, a first gate driver 32, a first differential amplifier 33, a second differential amplifier 34, a first voltage divider 35, a second voltage divider 36 and a reference voltage generator 37.

The first output transistor 31P is a PMOSFET (P-channel type Metal Oxide Semiconductor Field Effect Transistor) having a source connected to an input terminal of the input voltage Vin, a drain connected to an output terminal of the output voltage Vout, and a gate connected to an application terminal of a first control voltage GP (corresponding to an output terminal of the first gate driver 32). The first output transistor 31P may be a pnp type bipolar transistor.

The first gate driver 32 is a circuit block for generating the first control voltage GP in response to a first amplification voltage V33 and a second amplification voltage V34 and includes pnp type bipolar transistors 32*a* and 32*b*, a current source 32*c* and a resistor 32*d*.

The transistor 32*a* has an emitter connected to the input terminal of the input voltage Vin, a collector connected to the gate of the first output transistor 31P, and a base connected to an application terminal of the first amplification voltage V33 (corresponding to an output terminal of the first differential amplifier 33). The conductance of the transistor 32*a* configured as above is varied depending on the first amplification voltage V33. The transistor 32*a* may be a PMOSFET.

The transistor 32*b* has an emitter connected to the input terminal of the input voltage Vin, a collector connected to the gate of the first output transistor 31P, and a base connected to an application terminal of the second amplification voltage V34 (corresponding to an output terminal of the second differential amplifier 34). The conductance of the transistor 32*b* configured as above is varied depending on the second amplification voltage V34. The transistor 32*b* may be a PMOSFET.

The current source 32*c* is connected between the gate of the first output transistor 31P and the ground terminal and generates a predetermined constant current Ic. With the recent background of low power consumption and small circuit current, it is desirable to set the constant current Ic to be as small as possible (several nA to several μA) so as to reduce current consumption of the linear power supply circuit 30. Of course, if there is no limitation in current consumption, there is no need to set the constant current Ic to be as small as possible.

The resistor 32*d* is connected between the input terminal of the input voltage Vin and the gate of the first output transistor 31P and has high resistance (for example, several MQ).

The first differential amplifier 33 amplifies a difference between the feedback voltage Vfb input to its inverted input terminal (−) and a first reference voltage VrefP input to its non-inverted input terminal (+) and outputs the first amplification voltage V33. If the output voltage Vout falls within an input dynamic range of the first differential amplifier 33, the output voltage Vout may be directly input to the inverted input terminal (−).

The second differential amplifier 34 amplifies a difference between a first monitor voltage V35 input to its non-inverted input terminal (+) and a second monitor voltage V36 input to its inverted input terminal (−) and outputs the second amplification voltage V34. If both of the input voltage Vin and the output voltage Vout fall within an input dynamic range of the second differential amplifier 34, the input voltage Vin may be directly input to the non-inverted input terminal (+) and the output voltage Vout may be directly input to the inverted input terminal (−).

The first voltage divider 35 includes resistors 35*a* and 35*b* and divides the input voltage Vin according to a first voltage division ratio α (=R35*a*/(R35*a*+R35*b*)) to generate the first monitor voltage V35 (=α×Vin). A first end of the resistor R35*a* is connected to the ground terminal. A second end of the resistor R35*a* and a first end of the resistor R35*b* correspond to an output terminal of the first monitor voltage V35 and are connected to the non-inverted input terminal (+) of the second differential amplifier 34. A second end of the resistor R35*b* is connected to the input terminal of the input voltage Vin. The resistance of each of the resistors 35*a* and 35*b* can be arbitrarily adjusted by means of trimming or the like.

The second voltage divider 36 includes resistors 36*a* and 36*b* and divides the output voltage Vout according to a second voltage division ratio β (=R36*a*/(R36*a*+R36*b*)) to generate the second monitor voltage V36 (=β×Vout). A first end of the resistor R36*a* is connected to the ground terminal. A second end of the resistor R36*a* and a first end of the resistor R36*b* correspond to an output terminal of the second monitor voltage V36 and are connected to the inverted input terminal (−) of the second differential amplifier 34. A second end of the resistor R36*b* is connected to the input terminal of the output voltage Vout. The resistance of each of the resistors 36*a* and 36*b* can be arbitrarily adjusted by means of trimming or the like.

It is desirable to design the resistances of the resistors 35*a* and 35*b* and resistors 36*a* and 36*b* such that the first voltage division ratio α and the second voltage division ratio β are as close to be being equal as possible. According to such a design, it is possible to match the output voltage Vout with the input voltage Vin in operation of the second differential amplifier 34 (i.e., when the input voltage Vin is lower than a target value VtgP of the output voltage Vout, which will be described in detail later).

However, in reality, since the resistances have a production tolerance, it is difficult to exactly match the first voltage division ratio α with the second voltage division ratio β. Therefore, in consideration of the operation stability of the second differential amplifier 34, the first voltage division ratio α may be set to be slightly lower than the second voltage division ratio β (for example, α=0.994). In other words, the first voltage division ratio α and the second voltage division ratio β may be set such that the output voltage Vout is stabilized at a voltage value slightly lower than the input voltage Vin in the operation of the second differential amplifier 34. Such setting facilitates stable operation of the second differential amplifier 34 even when the resistances have a production tolerance.

The reference voltage generator 37 includes resistors 37*a* and 37*b* and divides the reference voltage Vreg to generate the first reference voltage VrefP (={R37*a*/(R37*a*+R37*b*)}× Vreg). A first end of the resistor R37*a* is connected to the ground terminal. A second end of the resistor R37*a* and a first end of the resistor R37*b* correspond to an output terminal of the first reference voltage VrefP and are connected to the non-inverted input terminal (+) of the first differential amplifier 33. A second end of the resistor R37*b* is connected to an input terminal of the reference voltage Vreg. The resistance of each of the resistors 37*a* and 37*b* can be arbitrarily adjusted by means of trimming or the like.

As described above, when the PMOSFET is used as the first output transistor 31P, a gate voltage thereof becomes lower than the input voltage Vin. Accordingly, it is possible to drive the linear power supply circuit 30 with a lower voltage.

In addition, the linear power supply circuit 30 of the first embodiment has not only the first differential amplifier 33 forming a first negative feedback loop for matching the feedback voltage Vfb with the first reference voltage VrefP (further matching the output voltage Vout with its target value VtgP) but also the second differential amplifier 34 forming a second negative feedback loop for causing the linear power supply circuit 30 to act as a buffer when the input voltage Vin is lower than the target value VtgP of the output voltage Vout. Hereinafter, the significance of introduction of the second differential amplifier 34 will be described in detail.

Figure 3A:
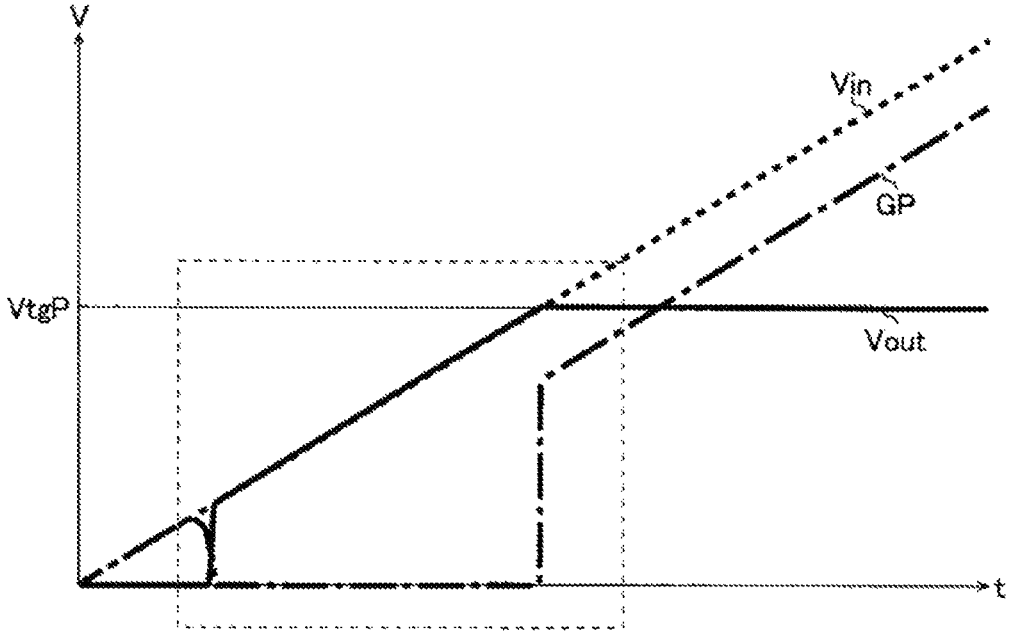
FIG. 3A is a time chart showing behaviors of Vin, Vout and GP (without buffer).
Figure 3B:
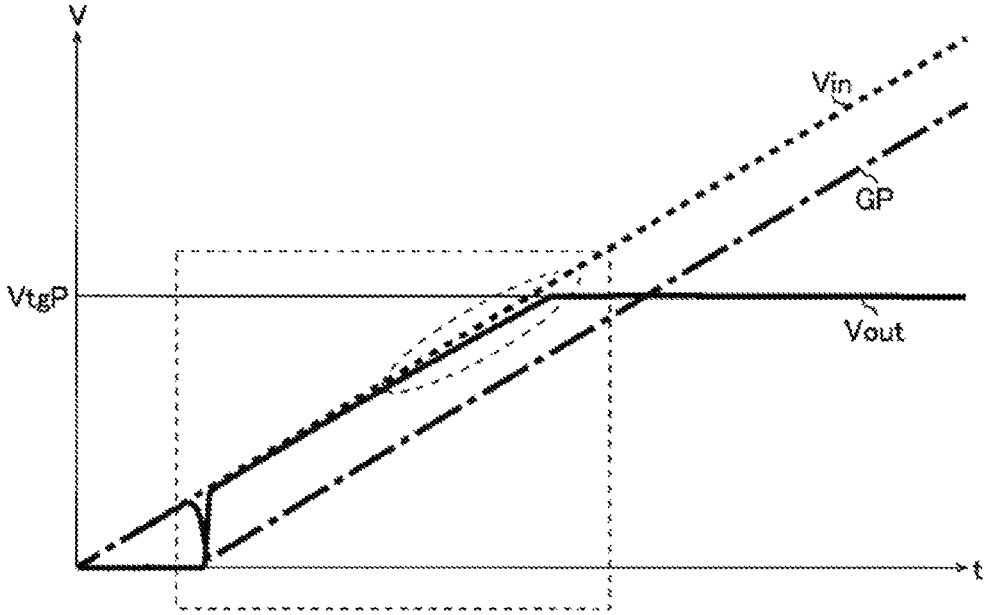
FIG. 3B is a time chart showing behaviors of Vin, Vout and GP (with buffer).

FIGS. 3A and 3B are time charts showing behaviors of the input voltage Vin (indicated by a dotted line), the output voltage Vout (indicated by a solid line) and the first control voltage GP (indicated by a dashed-dotted line). FIG. 3A shows a behavior in a case where the second differential amplifier 34 is not introduced and FIG. 3B shows a behavior in a case where the second differential amplifier 34 is introduced.

In a state where the input voltage Vin is lower than the target value VtgP of the output voltage Vout (see a dotted-line rectangular frame in FIGS. 3A and 3B), such as immediately after the start of the linear power supply circuit 30, it is obvious that the output voltage Vout is below its target value VtgP and further the feedback voltage Vfb is lower than the first reference voltage VrefP. In this state, since the first amplification voltage V33 generated in the first differential amplifier 33 becomes higher than the target value voltage VtgP, the transistor 32*a* is brought into a full-off state.

Therefore, in the case where the second differential amplifier 34 is not introduced (specifically, a case where the transistor 32*b*, the second differential amplifier 34, the first voltage divider 35 and the second voltage divider 36 are deleted from FIG. 2), as shown in FIG. 3A, since the first control voltage GP is stuck at a low level (0V) (i.e., a voltage corresponding to a lower limit of a control range) while the input voltage Vin is below its target value VtgP of the output voltage Vout, the first output transistor 31P is brought into a full-on state.

On the other hand, in the case where the second differential amplifier 34 is introduced, negative feedback control is applied to match the first monitor voltage V35 with the second monitor voltage V36 (imaginary short) by the action of the second differential amplifier 34. Specifically, the conductance of the transistor 32*b* is changed to decrease a difference between the input voltage Vin and the output voltage Vout. As a result, as shown in FIG. 3B, the first control voltage GP is changed to follow the input voltage Vin while maintaining a certain potential difference between the first control voltage GP and the input voltage Vin. In this way, since the first control voltage GP cannot be stuck to a low level by the introduction of the second differential amplifier 34, the full-on state of the first output transistor 31P is avoided.

Even in the above case, there is no change in that the input voltage Vin is output, almost as it is, as the output voltage Vout while the output voltage Vout is below its target value VtgP. However, control contents thereof are greatly different.

In other words, in the case where the second differential amplifier 34 is not introduced, the first negative feedback loop using the first differential amplifier 33 does not function effectively, and the first control voltage GP is unlimitedly decreased. As a result, the input voltage Vin is output, almost as it is, as the output voltage Vout.

On the other hand, in the case where the second differential amplifier 34 is introduced, the negative feedback control of the first control voltage GP is properly performed by the action of the second negative feedback loop using the second differential amplifier 34. As a result, the input voltage Vin is output, almost as it is, as the output voltage Vout. In addition, when the first voltage division ratio $\alpha$ is set to be slightly lower than the second voltage division ratio (3, the output voltage Vout deviates little by little as the input voltage Vin increases (see a dotted line elliptical frame in FIG. 3B).

Thereafter, when the input voltage Vin is increased and exceeds the target value VtgP of the output voltage Vout, the first differential amplifier 33 is brought into a balanced state. Therefore, negative feedback control is applied to match the feedback voltage Vfb with the first reference voltage VrefP (imaginary short) by the action of the first differential amplifier 33, and the output voltage Vout is accordingly matched to its target value VtgP. Specifically, the conductance of the transistor 32*a* (further the conductance of the first output transistor 31P) is changed to decrease a difference between the feedback voltage Vfb and the first reference voltage VrefP (further a difference between the output voltage Vout and its target value VtgP).

In addition, if the output voltage Vout is not increased to follow the input voltage Vin, since the input voltage Vin is always higher than the output voltage Vout, the second amplification voltage V34 generated in the second differential amplifier 34 becomes higher than the target value voltage VtgP. As a result, the transistor 32*b* is brought into a full-off state, thereby terminating the role of the second negative feedback loop.

In addition, in the first gate driver 32, a sum of a current Ia flowing to the transistor 32*a* and a current Ib flowing to the transistor 32*b* always has a constant value (i.e., a constant current Ic). In other words, the relationship of "Ia+Ib=Ic (a current flowing into the resistor 32*d* is ignored)" is established between the current Ia and the current Ib. Therefore, when the current Ia is increased, the current Ib is decreased accordingly, while, when the current Ia is decreased, the current Ib is increased accordingly. This configuration facilitates smooth switching between the first differential amplifier 33 and the second differential amplifier 34.

The behavior of the first control voltage GP may be summarized as follows. In the case where the second differential amplifier 34 is not introduced, as shown in FIG. 3A, the first control voltage GP is stuck to a low level when Vin<VtgP, and jumps from the low level to a predetermined voltage level (i.e., a voltage level at which the first differential amplifier 33 is brought into a balanced state) at the point of time when VintgP. Thereafter, according to the action of the first differential amplifier 33, the first control voltage GP is changed to follow the input voltage Vin while maintaining a certain potential difference between the first control voltage GP and the input voltage Vin.

On the other hand, in the case where the second differential amplifier 34 is introduced, as shown in FIG. 3B, the first control voltage GP is not stuck at a low level even when Vin<VtgP and, according to the action of the second differential amplifier 34, is changed to follow the input voltage Vin while maintaining a certain potential difference between the first control voltage GP and the input voltage Vin. Thereafter, the control subject is switched from the second differential amplifier 34 to the first differential amplifier 33 at the point of time when VintgP and the first control voltage GP is changed to continue to follow the input voltage Vin according to the action of the first differential amplifier 33.

In this way, in the linear power supply circuit 30 of the first embodiment, according to the introduction of the second differential amplifier 34, it is possible to avoid the sticking of the first control voltage GP to a low level (i.e., the full-on state of the first output transistor 31P) even when the input voltage Vin is lower than the target value VtgP of the output voltage Vout. Accordingly, since it is possible to suppress a width of variation of the first control voltage GP at the time of sudden change in the input voltage Vin (i.e., a width of variation the first control voltage GP required to maintain the output voltage Vout at its target value VtgP), it is possible to quickly drive the gate of the first output transistor 31P and further suppress an overshoot of the output voltage Vout. Hereinafter, the effect of suppressing the overshoot will be described in detail.

Figure 4A:
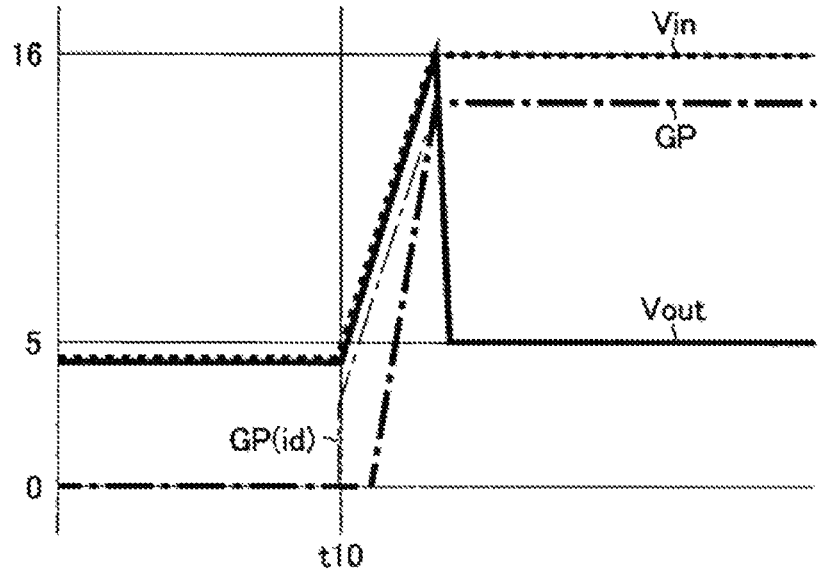
FIG. 4A is a time chart showing an effect of suppression of an overshoot (without buffer).
Figure 4B:
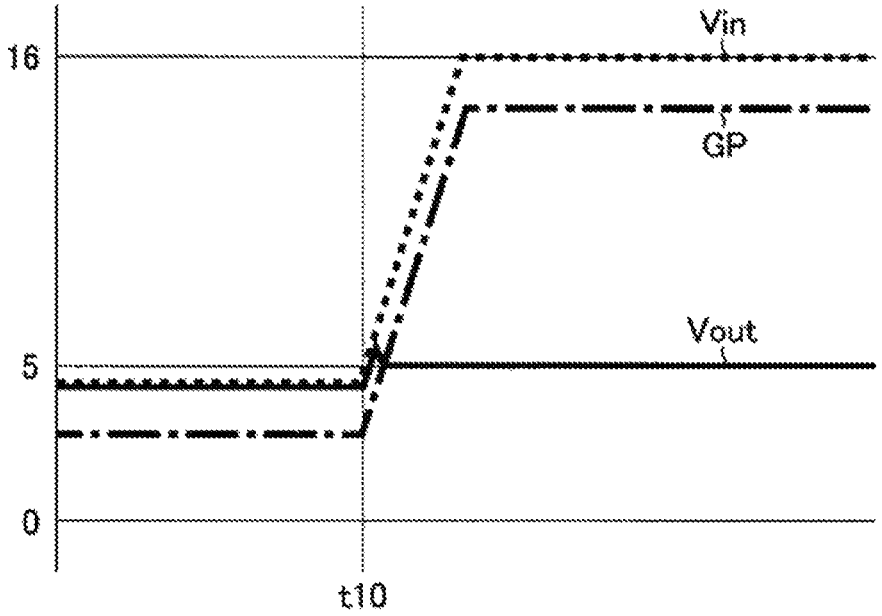
FIG. 4B is a time chart showing an effect of suppression of an overshoot (with buffer).

FIGS. 4A and 4B are time charts showing the effect of suppressing the overshoot of the output voltage Vout, depicting behaviors of the input voltage Vin (indicated by a dotted line), the output voltage Vout (indicated by a solid line) and the first control voltage GP (indicated by a dashed-dotted line). FIG. 4A shows a behavior in a case where the second differential amplifier 34 is not introduced and FIG. 4B shows a behavior in a case where the second differential amplifier 34 is introduced.

Simulation conditions as the premises are as follows: the target value VtgP of the output voltage Vout:5V (resistance R2/resistance R1 is equal to an appropriate value corresponding to the target value VtgP of the output voltage Vout), output current Tout:0 mA (no load), the output smoothing capacitor Cout:1 μF, and ambient temperature Ta (which is equal to junction temperature Tj):25 degrees C. Each figure depicts a behavior in a case where the input voltage Vin is steeply increased from a voltage slightly lower than 5V to 16V at time t10.

First, the principle of generation of the overshoot of the output voltage Vout will be described. Due to a device structure, parasitic capacitors Cgs and Cgd are respectively formed between the gate and source of the first output transistor 31P and between the gate and drain thereof. Capacitances of the parasitic capacitors Cgs and Cgd are in proportion to the device size of the first output transistor 31P. Basically, among elements constituting the linear power supply circuit 30, the first output transistor 31P acting as a power transistor at an output stage requires the highest current capability, which inevitably increases the number of cells in the first output transistor 31P. Therefore, the total capacitance of the parasitic capacitors Cgs and Cgd formed in the cells increases.

When the parasitic capacitors Cgs and Cgd are formed in the output transistor 31P in this manner, it takes time to charge and discharge the parasitic capacitors Cgs and Cgd in variable control of the first control voltage GP. Therefore, the first control voltage GP cannot be made to follow the input voltage Vin when the input voltage Vin changes rapidly, and accordingly an unintended overshoot (i.e., a state where the output voltage Vout is higher than its target value VtgP) may occur in the output voltage Vout.

In addition, when the second differential amplifier 34 is not introduced, as shown in FIG. 4A, the first control voltage GP is stuck to a low level (0V) while the input voltage Vin is lower than the target value VtgP of the output voltage Vout. Therefore, when the input voltage Vin rises rapidly at time t10, the first control voltage GP has to be pulled up from the low level (0V) to the original voltage level (i.e., a voltage level at which the first differential amplifier 33 is brought into the balanced state).

At this time, if the first control voltage GP exhibits the ideal rising behavior (see a thin dashed-dotted line GP(id)), no particular problem occurs. However, the real rising behavior (see a thick dashed-dotted line GP) becomes later than the ideal rising behavior due to the effect of the parasitic capacitors Cgs and Cgd. As a result, since a gate-source voltage Vgs (=Vin−GP) of the first output transistor 31P is unnecessarily increased and the conductance of the first output transistor 31P becomes larger than its original conductance, an unintended overshoot occurs in the output voltage Vout.

In particular, in the worst case where the input voltage Vin is rapidly increased from a voltage slightly lower than the target value VtgP of the output voltage Vout, the first control voltage GP begins to be pulled up starting at a state where there is a great difference between the input voltage Vin and the first control voltage GP (i.e., a state where the gate-source voltage Vgs of the first output transistor 31P is high). Therefore, delay of the rising behavior of the first control voltage GP becomes more apparent, and the overshoot of the output voltage Vout becomes larger.

On the other hand, when the second differential amplifier 34 is introduced, as shown in FIG. 4B, even while the input voltage Vin is lower than the target value VtgP of the output voltage Vout, the first control voltage GP is maintained at a voltage level at which a certain potential difference is maintained between the first control voltage GP and the input voltage Vin. Therefore, even when the input voltage Vin rapidly rises at time t10, the first control voltage GP is not pulled up from the low level (0V), thereby being less susceptible to the parasitic capacitors Cgs and Cgd. As a result, since the first control voltage GP can follow the input voltage Vin with no delay, it is possible to suppress the overshoot of the output voltage Vout in advance.

Existing measures against the overshoot may include a method for increasing a gain of a negative feedback loop and a method for detecting an overshoot and interrupting an output transistor. However, the former existing method has difficulty in achieving phase compensation of the negative feedback loop and requires a measure using external parts, which may result in a conflict of a low degree of freedom of external part selection. On the other hand, the latter existing method was not a measure initiated on account of the structure of detecting and suppressing an overshoot. In addition, the latter existing method had a mutual interference between the overshoot suppression control and the inherit negative feedback control, which may cause an unstable output state.

On the contrary, since the linear power supply circuit 30 of the first embodiment can eliminate the root cause of overshoot (a state where the gate of the first output transistor 31P is greatly opened), it is possible to improve transient characteristics for rapid change in the input voltage Vin and avoid the overshoot of the output voltage Vout in advance, without causing the above-mentioned conflict.

Linear Power Supply Circuit (Second Embodiment)

Figure 5:
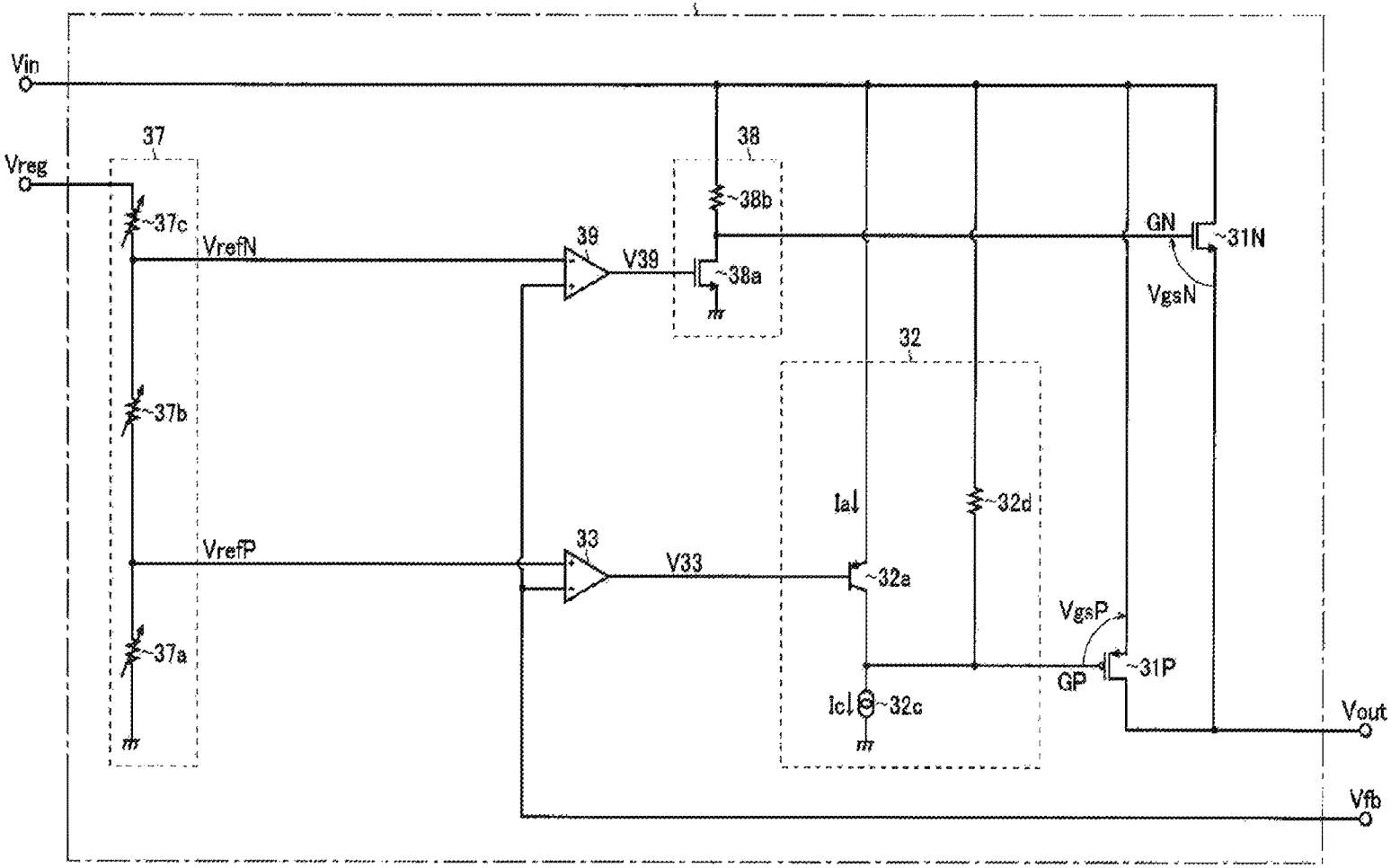
FIG. 5 is a circuit diagram showing a linear power supply circuit 30 according to a second embodiment.

FIG. 5 is a circuit diagram showing a linear power supply circuit 30 according to a second embodiment. The linear power supply circuit 30 of the second embodiment includes a first output transistor 31P, a second output transistor 31N, a first gate driver 32, a first differential amplifier 33, a reference voltage generator 37, a second gate driver 38 and a third differential amplifier 39.

Thus, in the linear power supply circuit 30 of the second embodiment, as compared to the first embodiment, the second differential amplifier 34 and the first and second voltage dividers 35 and 36 are deleted while the second output transistor 31N, the second gate driver 38 and the third differential amplifier 39 are added. In addition, according to such a modification, the circuit configuration of the first gate driver 32 and reference voltage generator 37 is partially changed.

In the second embodiment, the same elements as those in the first embodiment are denoted by the same reference numerals as in FIG. 2 and, therefore, explanation of which are not repeated. The following description will be focused on the characteristic portions of the second embodiment.

The second output transistor 31N is an NMOSFET (N-channel type Metal Oxide Semiconductor Field Effect Transistor) having a drain connected to an input terminal of the input voltage Vin, a source connected to an output terminal of the output voltage Vout, and a gate connected to an application terminal of a second control voltage GN (or an output terminal of the second gate driver 38). The second output transistor 31N may be an npn type bipolar transistor.

The first gate driver 32 includes a pnp type bipolar transistor 32*a*, a current source 32*c* and a resistor 32*d* and generates the first control voltage GP in response to the first amplification voltage V33. In this manner, in the first gate driver 32 of the second embodiment, the pnp type bipolar transistor 32*b* is deleted, unlike the first embodiment.

The reference voltage generator 37 includes resistors 37*a* to 37*c* and divides the reference voltage Vreg to generate a first reference voltage VrefP (={R37*a*/(R37*a*+R37*b*+R37*c*)}×Vreg) and a second reference voltage VrefN (={(R37*a*+R37*b*)/(R37*a*+R37*b*+R37*c*)}×Vreg). A first end of the resistor R37*a* is connected to the ground terminal. A second end of the resistor R37*a* and a first end of the resistor R37*b* correspond to an output terminal of the first reference voltage VrefP and are connected to the non-inverted input terminal (+) of the first differential amplifier 33. A second end of the resistor R37*b* and a first end of the resistor R37*c* correspond to an output terminal of the second reference voltage VrefN and are connected to the non-inverted input terminal (+) of the second differential amplifier 39. A second end of the resistor R37*c* is connected to an input terminal of the reference voltage Vreg. The resistance of each of the resistors 37*a* to 37*c* can be arbitrarily adjusted by means of trimming or the like. In this manner, in the reference voltage generator 37 of the second embodiment, the resistor 37*c* is newly added, as compared with the first embodiment.

The second gate driver 38 includes an NMOSFET 38*a* and a resistor 38*b* and generates the second control voltage GN in response to a third amplification voltage V39. The NMOSFET 38*a* has a source connected to the ground terminal, a drain connected to the gate of the second output transistor 31N, and a gate connected to an application terminal of the third amplification voltage V39 (an output terminal of the third differential amplifier 39). The conductance of the transistor 38*a* connected thus is varied depending on the third amplification voltage V39. The transistor 38*a* may be an npn type bipolar transistor.

The resistor 38*b* is connected between the input terminal of the input voltage Vin and the gate of the second output transistor 31N. The resistor 32*d* conforms to Ohm's law and is required to be multiplied with a constant current Ic to secure VgsP of the transistor 31P (for example, if the constant current Ic is an order of several μA and VgsP is an order of several V, the resistor 32*d* has a resistance of an order of several MQ as a result of VgsP/Ic). On the other hand, unlike the resistor 32*d*, the resistor 38*b* is not required to secure VgsN of the transistor 31N, but is inserted for current limitation of the second gate driver 38 and logic fixing between the drain and gate of the transistor 31N temporarily just in a transient response. Therefore, the resistor 38*b* need not have so high resistance (the resistor 38*b* has an order of several tens to several hundred of kQ, while the resistor 32*d* has an order of several MQ). Of course, if there is no current limitation in the current source 32*c*, the resistor 32*d* need not have so high resistance (of an order of several MQ). Further, if the second output transistor 31N is always in an ON state, the resistor 38*b* may be in an order of more than several tens to several hundred kQ.

The third differential amplifier 39 amplifies a difference between the feedback voltage Vfb input to its non-inverted input terminal (+) and the second reference voltage VrefN input to its inverted input terminal (−) to output the third amplification voltage V39. If the output voltage Vout falls within an input dynamic range of the third differential amplifier 39, the output voltage Vout may be directly input to the non-inverted input terminal (+).

In this way, the linear power supply circuit 30 of the second embodiment uses both of the first output transistor 31P (PMOSFET) and second output transistor 31N (NMOSFET) connected in parallel, and is provided with the first negative feedback loop (including the first gate driver 32 and the first differential amplifier 33) and the third negative feedback loop (including the second gate driver 38 and the third differential amplifier 39) as means for controlling the respective conductance thereof.

Further, the first reference voltage VrefP and the second reference voltage VrefN are generated by dividing the common reference voltage Vreg, and the second reference voltage VrefN is set to be slightly higher than the first reference voltage VrefP. In other words, the first negative feedback loop using the first differential amplifier 33 controls the conductance of the first output transistor 31P such that the feedback voltage Vfb matches the first reference voltage VrefP (that is, the output voltage Vout matches the first target value VtgP). On the other hand, the third negative feedback loop using the third differential amplifier 39 controls the conductance of the second output transistor 31N such that the feedback voltage Vfb matches the second reference voltage VrefN slightly higher than the first reference voltage VrefP (that is, the output voltage Vout matches the second target value VtgN slightly higher than the first target value VtgP).

Hereinafter, the technical significance of the employment of the second embodiment will be described in conjunction with the operation of the linear power supply circuit 30.

Figure 6:
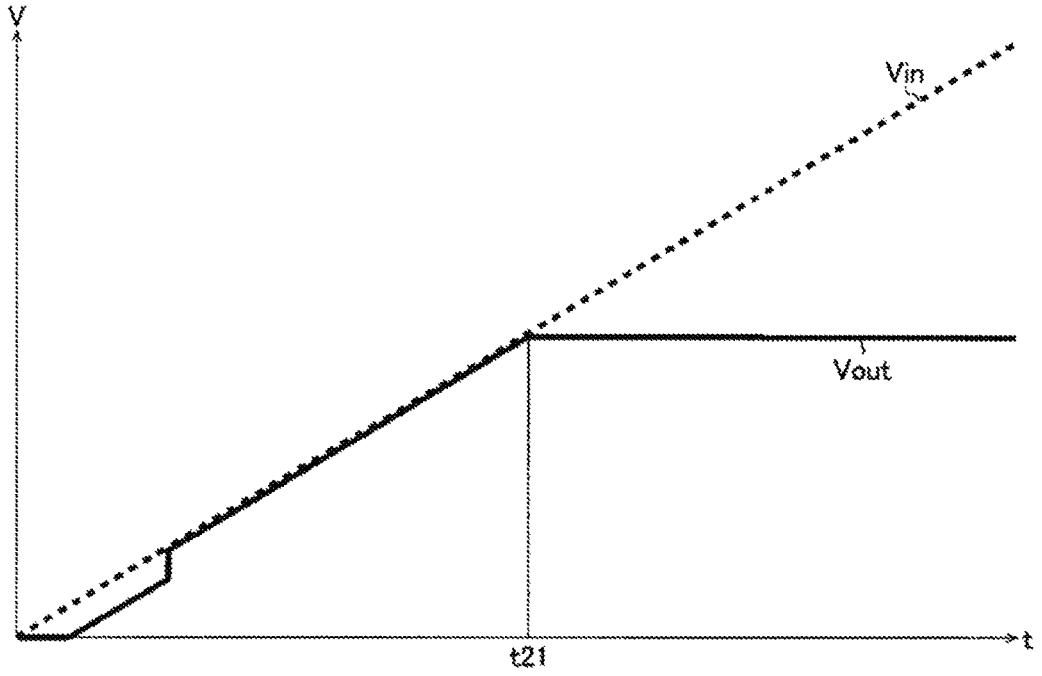
FIG. 6 is a time chart showing behaviors of Vin and Vout.
Figure 7:
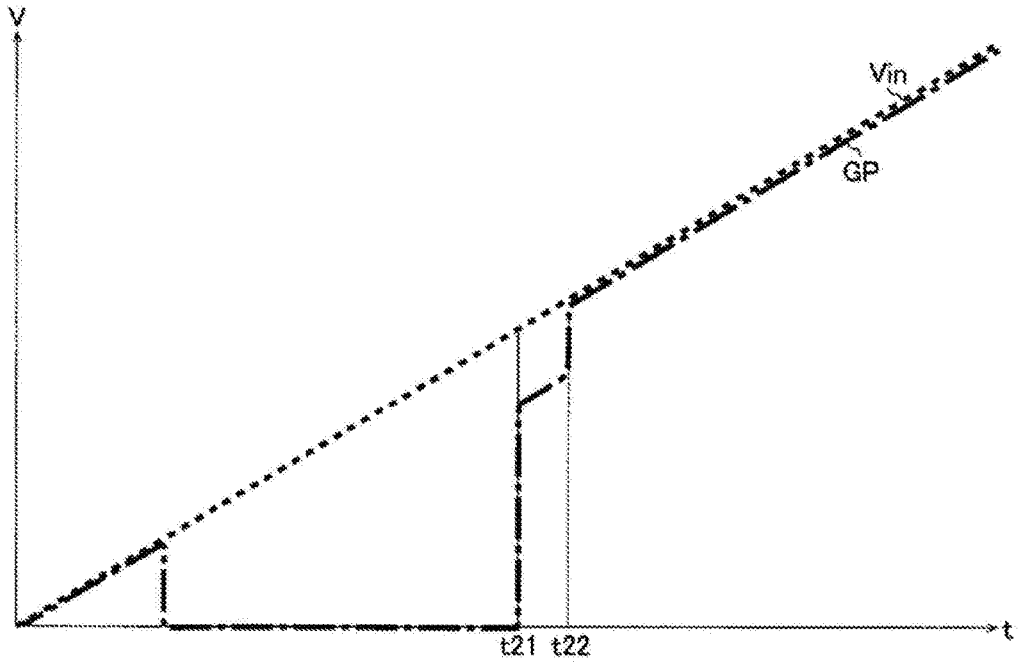
FIG. 7 is a time chart showing behaviors of Vin and GP.
Figure 8:
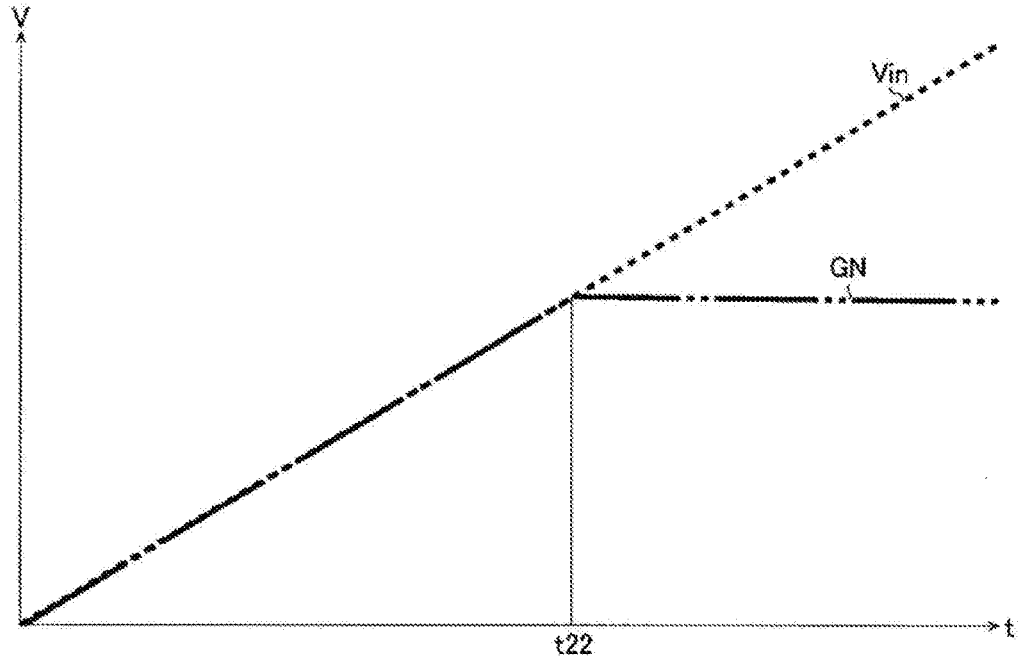
FIG. 8 is a time chart showing behaviors of Vin and GN.
Figure 9:
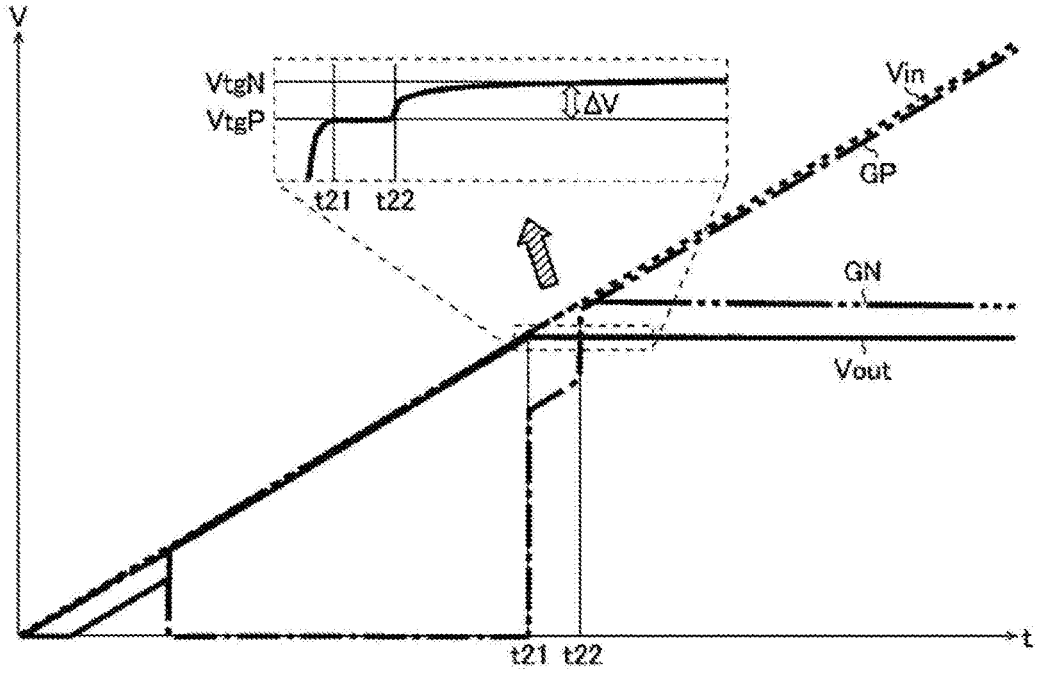
FIG. 9 is a time chart showing behaviors of Vin, Vout, GP and GN.

FIGS. 6 to 9 are time charts showing behaviors of the input voltage Vin (indicated by a dotted line), the output voltage Vout (indicated by a solid line), the first control voltage GP (indicated by a dashed-dotted line), and the second control voltage GN (indicated by a dashed-two dotted line), respectively, in the linear power supply circuit 30 of the second embodiment. FIG. 6 shows a Vin-Vout correlation, FIG. 7 shows a Vin-GP correlation, FIG. 8 shows a Vin-GN correlation, and FIG. 9 shows a superimposition of FIGS. 6 to 8.

Prior to time t21, when the input voltage Vin is lower than the first target value VtgP of the output voltage Vout, since the feedback voltage Vfb is lower than the first reference voltage VrefP, the first amplification voltage V33 becomes higher than the target value voltage VtgP. Accordingly, the transistor 32*a* is in a full-off state and the first control voltage GP is in a state where it is stuck at a low level (0V). As a result, the first output transistor 31P is brought into a full-on state and, accordingly, the input voltage Vin is output and is substantially unchanged, as the output voltage Vout.

In addition, when the input voltage Vin is lower than the first target value VtgP of the output voltage Vout, since the feedback voltage Vfb is lower than the second reference voltage VrefN, the third amplification voltage V39 runs out of a low level. Accordingly, the NMOSFET 38*a* is in a full-off state, and the second control voltage GN is in a state where it is stuck to a high level (Vin). However, at this point, since the gate-source voltage VgsN (=GN−Vout) of the second output transistor 31N approaches 0V, the second output transistor 31N is kept at the off state.

Thereafter, at time t21, when the input voltage Vin exceeds the first target value VtgP of the output voltage Vout, as the first differential amplifier 33 reaches a balanced state, the output voltage Vout is matched to its first target value VtgP. At this point, the first control voltage GP jumps from a low level to a predetermined voltage level (a voltage level at which the first differential amplifier 33 is brought into a balanced state), and then is changed to follow the input voltage Vin according to the action of the first differential amplifier 33, while a certain potential difference is maintained between with the first control voltage GP and the input voltage Vin.

Thereafter, when the input voltage Vin rises and the gate-source voltage VgsN (=GN−Vout≅Vin−VtgP) of the second output transistor 31N is higher than an ON-threshold voltage VthN at time t22, the second output transistor 31N begins to be conducted. At this time, since the feedback voltage Vfb is higher than the first reference voltage VrefP, the first amplification voltage V33 is lower than the target value voltage VtgP. As a result, as the transistor 32*a* is brought into a full-off state and the first control voltage GP is stuck at a high level (Vin), the first output transistor 31P is brought into a full-off state, thereby terminating the role of the first negative feedback loop.

On the other hand, after time t22, according to the action of the third differential amplifier 39, negative feedback control is applied to match the output voltage Vout with the second target value VtgN. At this time, the second control voltage GN is stabilized while a certain potential difference is maintained between the second control voltage GN and the output voltage Vout.

In addition, it is essential that the second target value VtgN is set to be higher than the first target value VtgP. However, if the second target value VtgN is set to be too high, a variation width ΔV (=VtgN−VtgP) of the output voltage Vout before and after time t22 is increased, which may have an adverse effect on a subsequent stage. In view of this, the first reference voltage VrefP and the second reference voltage VrefN (further, the first target value VtgP and the second target value VtgN) may be set appropriately such that the variation width ΔV falls within an appropriate range (for example, of several mV to several tens of mV, which is higher than an offset voltage of each of the first and third differential amplifiers 33 and 39.

Here, the characteristics of the first and second output transistors 31P and 31N will be rechecked.

Driving the second output transistor 31N requires an input voltage Vin to satisfy at least the condition of "Vin≥Vout+VthN (VthN is an ON-threshold voltage of the second output transistor 31N)." On the other hand, the first output transistor 31P does not have such a limitation and accordingly can be driven with a lower input voltage Vin. Thus, in the aspect of low voltage driving, it is more advantageous to use the first output transistor 31P than the second output transistor 31N.

However, as compared to the second output transistor 31N, the first output transistor 31P has a poor response to a load variation (particularly, rapid increase in output current Tout). This is because the first gate driver 32 is different in configuration from the second gate driver 38.

With the recent demand for low power consumption, a driving current of the first gate driver 32 (constant current Ic drawn by the current source 32*c*) is designed to be very small (several μA) and the resistor 32*d* for pull-up is designed to have very high resistance (several MQ). In addition, as described earlier, since the first output transistor 31P acting as a power transistor at an output stage requires the highest current capability among elements constituting the linear power supply circuit 30, the number of cells increases inevitably and, therefore, the total capacitance of the parasitic capacitors Cgs and Cgd formed in the cells increases. Therefore, since it takes time to charge and discharge the parasitic capacitors Cgs and Cgd formed in the first output transistor 31P in variable control of the first control voltage GP, it is difficult to change the conductance of the first output transistor 31P with no delay in response to a load variation.

On the other hand, in order to increase the conductance of the second output transistor 31N, the NMOSFET 38*a* of the second gate driver 38 may be turned off, and charges may be injected from the input terminal of the input voltage Vin into the gate of the second output transistor 31N via the resistor 38*b*. In addition, unlike the resistor 32*d* for pull-up, the resistor 38*b* may be designed to have a sufficiently low resistance (of an order of several tens of kQ to several hundred kQ). Accordingly, it is relatively easy to change the conductance of the second output transistor 31N with no delay in response to a load variation. Thus, in the aspect of load response characteristics, it is more advantageous to use the second output transistor 31N than the first output transistor 31P.

In view of the above characteristics, in the linear power supply circuit 30 of the second embodiment, the output transistor outputs a result of an OR operation of a PMOSFET and an NMOSFET, and there is a small difference between target values of the output voltages Vout in their respective negative feedback controls. With this configuration, when the input voltage Vin is decreased (i.e., when the input voltage Vin is below an operation lower limit voltage of the NMOSFET), the PMOSFET is used to perform the output operation. On the other hand, when the decrease in the input voltage Vin is stopped, without requiring special control, it is possible to achieve a natural switching from the output operation using the PMOSFET to the output operation using the NMOSFET.

In other words, according to the linear power supply circuit 30 of the second embodiment, when the input voltage Vin is decreased, the first output transistor 31P is used to achieve low voltage driving. On the other hand, when the decrease in the input voltage Vin is stopped, the second output transistor 31N is used to improve the load responsiveness and suppress an undershoot of the output voltage Vout (i.e., a state where the output voltage Vout is lower than the target value VtgP).

Figure 10:
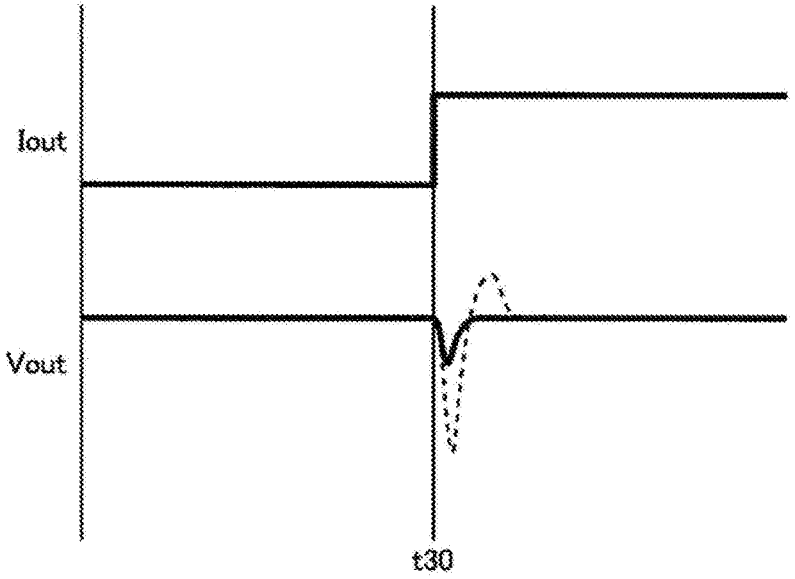
FIG. 10 is a time chart showing an effect of suppression of an undershoot.

FIG. 10 is a time chart showing an effect of suppression of an undershoot of the output voltage Vout, depicting behaviors of the output current Tout and the output voltage Vout in this order from above. In this figure, a dotted line of the output voltage Vout shows an output behavior when a PMOSFET (the first output transistor 31P) is used, and a solid line of the output voltage Vout shows an output behavior when an NMOSFET (the second output transistor 31N) is used.

At time t30, when the output current Tout flowing from the linear power supply circuit 30 to a load is steeply increased, there is a need to increase the conductance of the output transistor with no delay in order to maintain the output voltage Vout at the target value.

In addition, at time t30, when an output operation is performed by the first output transistor 31P, since the conductance of the first output transistor 31P cannot be quickly changed, a large undershoot (or an overshoot after that) occurs in the output voltage Vout (see the dotted line).

On the other hand, when the output operation is performed by the second output transistor 31N, since the conductance of the second output transistor 31N can be increased with no delay, it is possible to significantly suppress an undershoot of the output voltage Vout (see the solid line).

Linear Power Supply Circuit (Third Embodiment)

Figure 11:
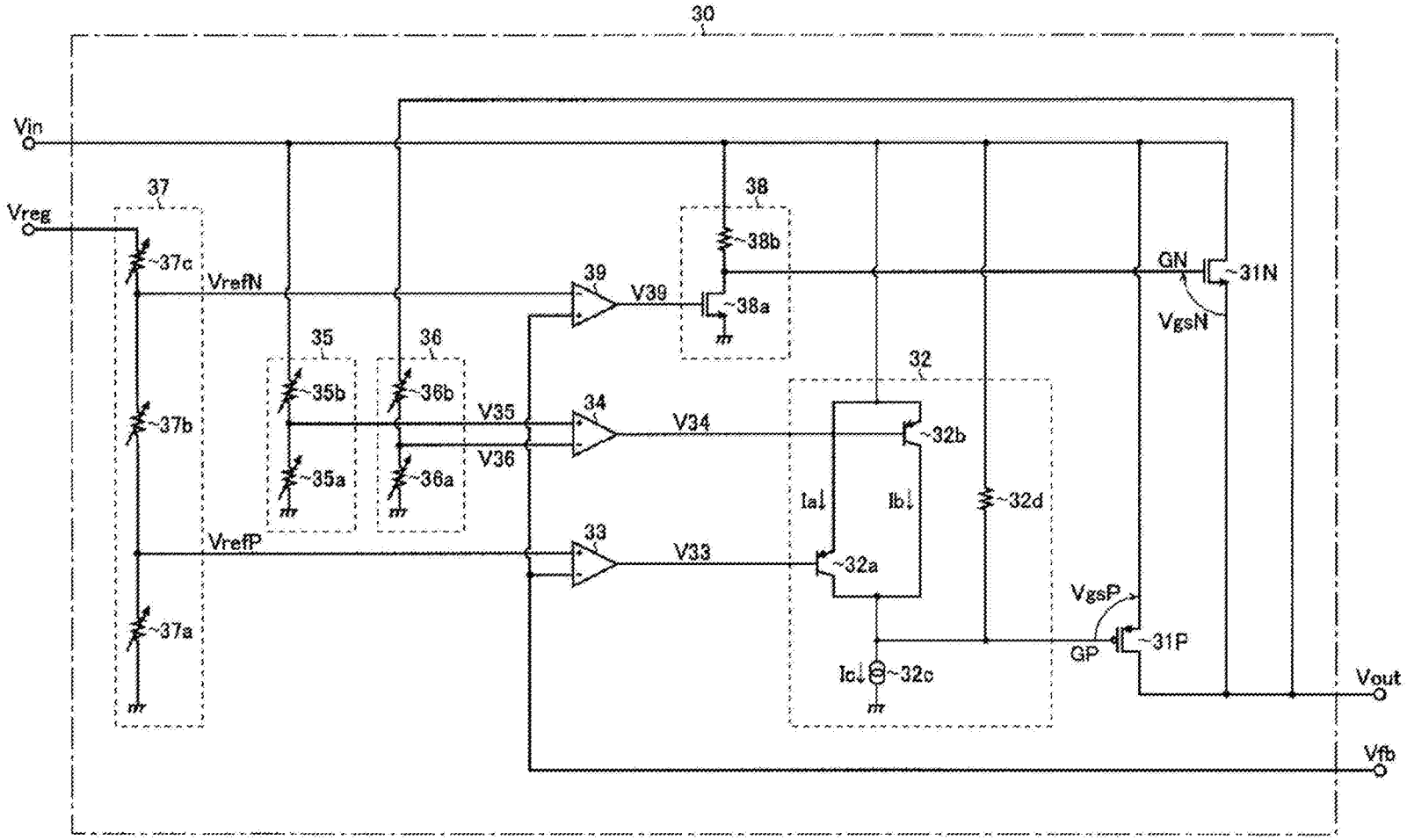
FIG. 11 is a circuit diagram showing a linear power supply circuit 30 according to a third embodiment.

FIG. 11 is a circuit diagram showing a linear power supply circuit 30 according to a third embodiment. The linear power supply circuit 30 of the third embodiment is obtained by a combination of the first embodiment (FIG. 2) and the second embodiment (FIG. 5), and includes a first output transistor 31P, a second output transistor 31N, a first gate driver 32, a first differential amplifier 33, a second differential amplifier 34, a first voltage divider 35, a second voltage divider 36, a reference voltage generator 37, a second gate driver 38 and a third differential amplifier 39. The first gate driver 32 has the same configuration as that of the first embodiment (FIG. 2), and the reference voltage generator 37 has the same configuration as that of the second embodiment (FIG. 5).

Figure 12:
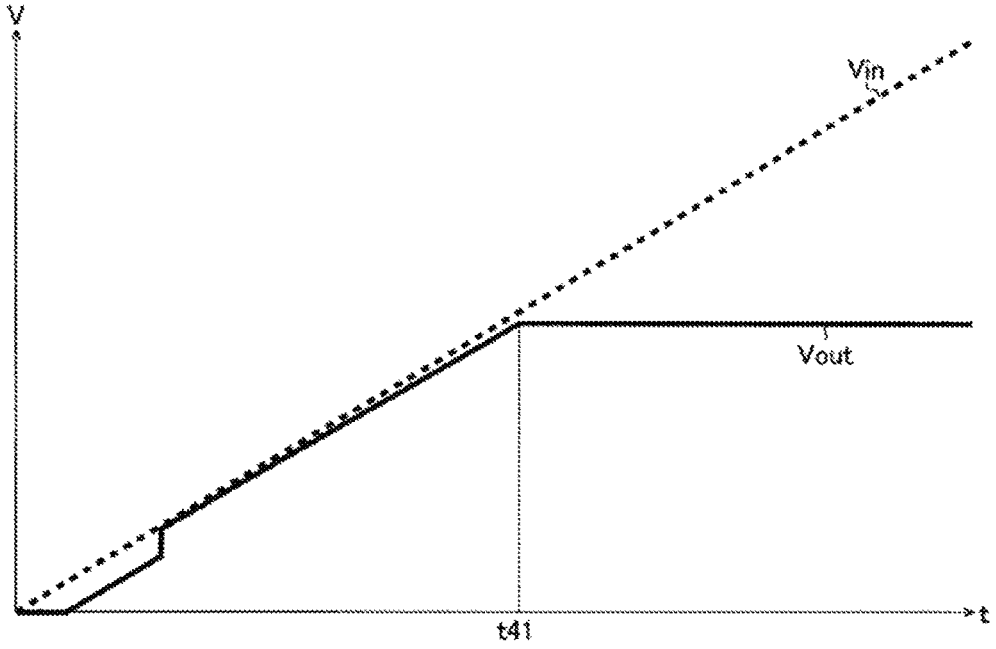
FIG. 12 is a time chart showing behaviors of Vin and Vout.
Figure 13:
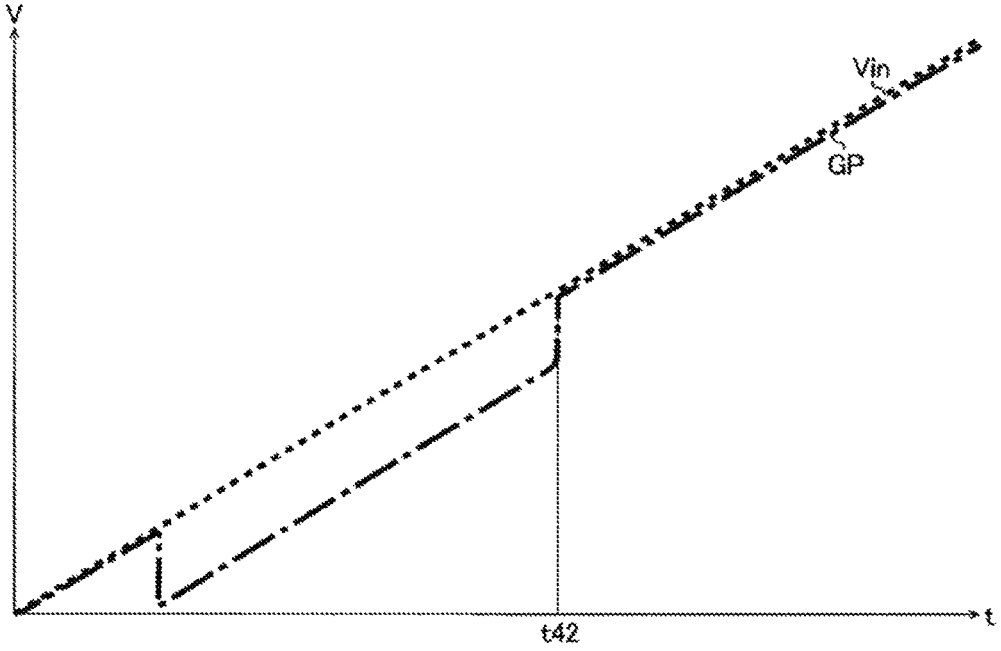
FIG. 13 is a time chart showing behaviors of Vin and GP.
Figure 14:
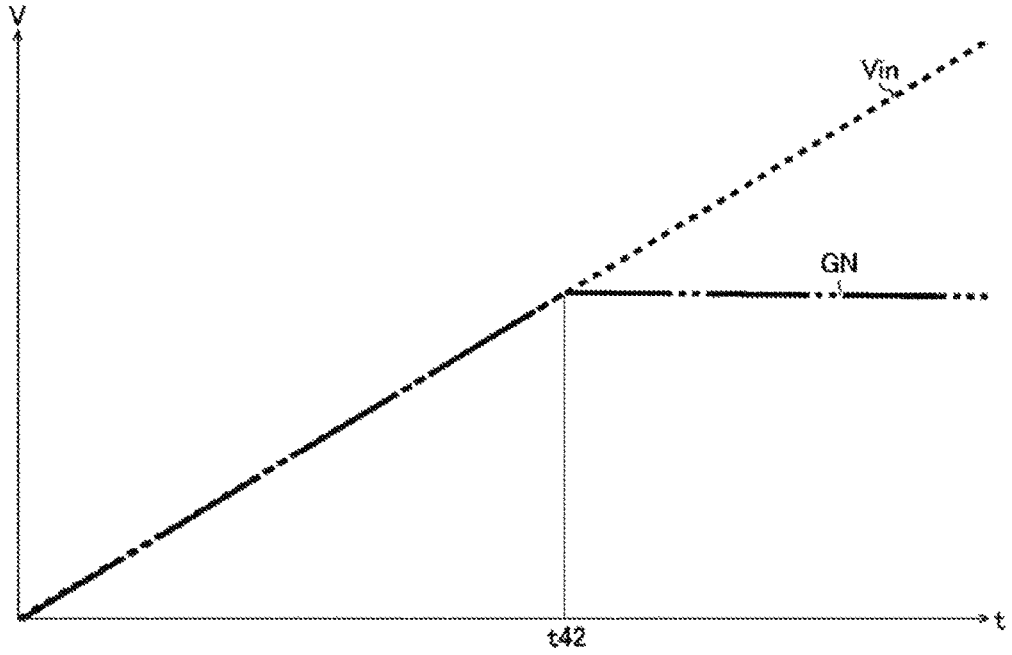
FIG. 14 is a time chart showing behaviors of Vin and GN.
Figure 15:
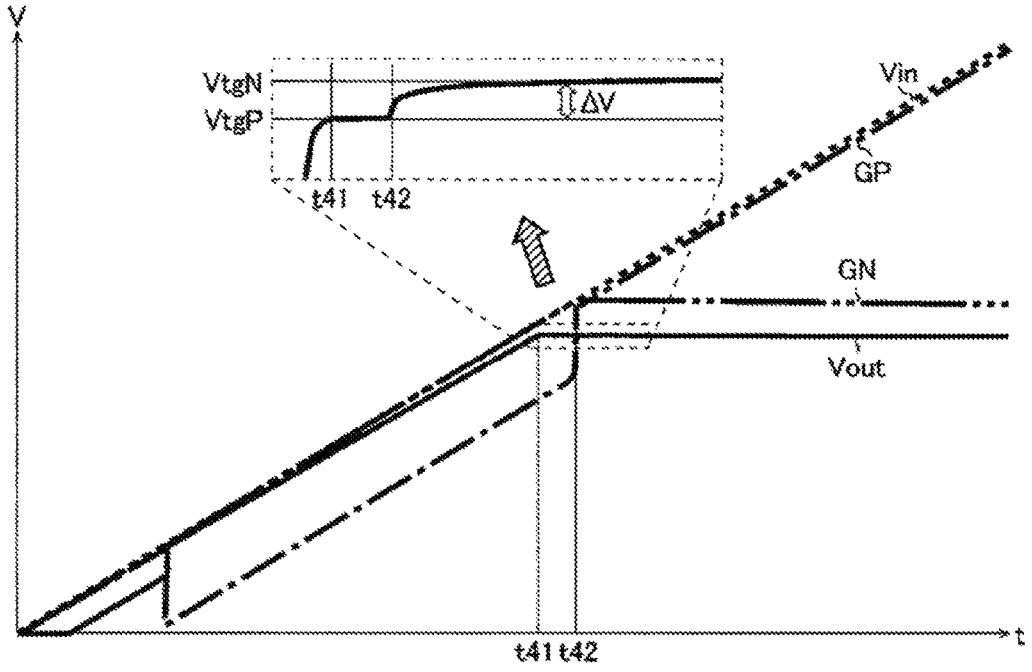
FIG. 15 is a time chart showing behaviors of Vin, Vout, GP and GN.

FIGS. 12 to 15 are time charts showing behaviors of the input voltage Vin (indicated by a dotted line), the output voltage Vout (indicated by a solid line), the first control voltage GP (indicated by a dashed-dotted line), and the second control voltage GN (indicated by a dashed-two dotted line), respectively, in the linear power supply circuit 30 of the third embodiment. FIG. 12 shows a Vin-Vout correlation, FIG. 13 shows a Vin-GP correlation, FIG. 14 shows a Vin-GN correlation, and FIG. 15 shows a superimposition of FIGS. 12 to 14. The behavior of the third embodiment is a combination of the behavior of the first embodiment (FIG. 3B) and the behavior of the second embodiment (FIG. 9).

Prior to time t41, when the input voltage Vin is lower than the first target value VtgP of the output voltage Vout, according to the action of the second differential amplifier 34, the first control voltage GP is not stuck to a low level and is changed to follow the input voltage Vin.

As a result, since the pull-on state of the first output transistor 31P can be avoided, it is possible to suppress the overshoot in advance at the time of sudden change in the input voltage Vin.

Thereafter, at time t41, when the input voltage Vin exceeds the first target value VtgP of the output voltage Vout, as the first differential amplifier 33 reaches a balanced state, the control subject of the first output transistor 31P is switched from the second differential amplifier 34 to the first differential amplifier 33, and the first control voltage GP is changed to continue to follow the input voltage Vin according to the action of the first differential amplifier 33.

In addition, if the output voltage Vout is not increased to follow the input voltage Vin, since the input voltage Vin is always higher than the output voltage Vout, the second amplification voltage V34 generated in the second differential amplifier 34 becomes higher than the target value voltage VtgP. As a result, the transistor 32*b* is brought into a full-off state, thereby terminating the role of the second negative feedback loop.

Thereafter, when the input voltage Vin rises and the gate-source voltage VgsN (=GN−Vout≅Vin−VtgP) of the second output transistor 31N is higher than an ON-threshold voltage VthN at time t42, the second output transistor 31N begins to be conducted. At this time, since the feedback voltage Vfb is higher than the first reference voltage VrefP, the first amplification voltage V33 is lower than the target value voltage VtgP. As a result, as the transistor 32*a* is brought into a full-on state and the first control voltage GP is stuck at a high level (Vin), the first output transistor 31P is brought into a full-off state, thereby terminating the role of the first negative feedback loop.

Finally, after time t42, according to the action of the third differential amplifier 39 (further the third negative feedback loop), negative feedback control is applied to match the output voltage Vout with the second target value VtgN. In this way, after the decrease in the input voltage Vin is stopped, since an output operation is performed by the second output transistor 31N, it is possible to significantly suppress an undershoot at the time of sudden change in the output current Tout. This is the same as that described in detail in the second embodiment.

As described above, according to the linear power supply circuit 30 of the third embodiment, it is possible to achieve both of the benefits of the first embodiment (improvement of response characteristics to an input variation) and the benefits of the second embodiment (improvement of response characteristics to a load variation).

<Application to Vehicle>

Figure 16:
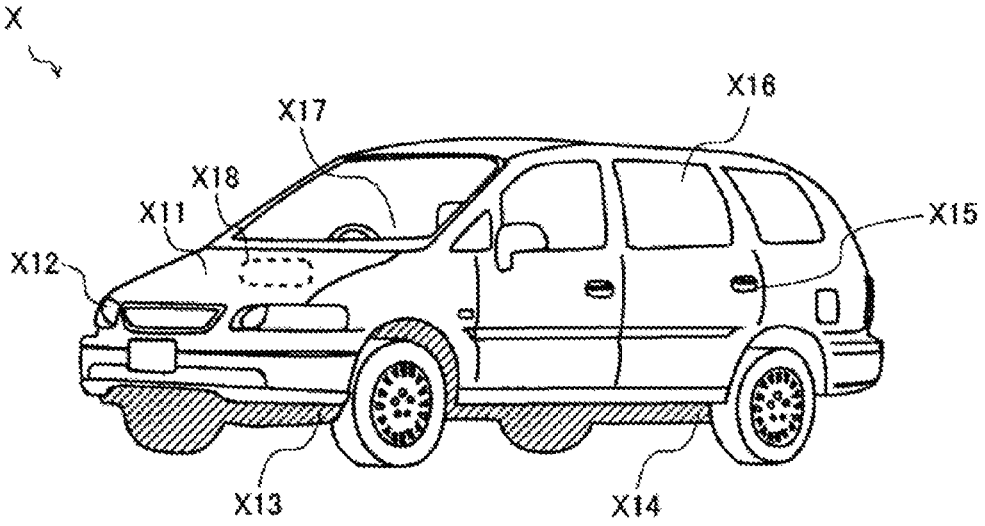
FIG. 16 is an external view showing one configuration example of a vehicle X.

FIG. 16 is an external view showing one configuration example of a vehicle X. The vehicle X of this configuration is equipped with various kinds of electronic devices X11 to X18 which are operated with a battery voltage Vbat supplied from a battery (not shown). The mounting positions of the electronic devices X11 to X18 in this figure may differ from actual ones, for convenience of illustration.

The electronic device X11 is an engine control unit for performing engine-related controls (such as injection control, electronic throttle control, idling control, oxygen sensor heater control and auto cruise control).

The electronic device X12 is a lamp control unit for controlling light-on/off of HID (High Intensity Discharged lamp), DRL (Daytime Running Lamp) or the like.

The electronic device X13 is a transmission control unit for performing transmission-related controls.

The electronic device X14 is a body control unit for performing controls related to motion of the vehicle X (such as ABS (Anti-lock Brake System) control, EPS (Electronic Power Steering) control and electronic suspension control).

The electronic device X15 is a security control unit for driving and controlling a door lock, a crime prevention alarm, and so on.

The electronic device X16 is electronic devices incorporated in the vehicle X at a factory shipping stage, as standard equipment and maker options such as a wiper, an electric door mirror, a power window, a damper (shock absorber), an electric sunroof and an electric seat.

The electronic device X17 is electronic devices optionally equipped in the vehicle X, as user options such as an in-vehicle AN (Audio/Visual), a car navigation system and ETC (Electronic Toll Collection system).

The electronic device X18 is electronic devices including high voltage-resistant motors such as an in-vehicle blower, an oil pump, a water pump and a battery cooling fan.

The earlier-described linear power supply 1 may be incorporated in any of the electronic devices X11 to X18. The above linear power supply 1 with improved transient characteristics can suppress an overshoot and an undershoot of the output voltage Vout even when the battery voltage Vbat (corresponding to the above-mentioned input voltage Vin) and a load current are steeply varied, thereby allowing appropriate power to be supplied to various parts of the electronic devices X11 to X18.

Of course, the application target of the linear power supply 1 is not limited to the electronic devices X11 to X18 equipped in the vehicle X, but may be applied to robot equipment such as a robot suit and an industrial robot, as well as consumer equipment such as a home appliance, a portable device and a wearable device. The linear power supply 1 can generate a desired output voltage from a wider range of input voltage (from low input voltage to high input voltage) than conventional. In particular, when a high input voltage or a large current is handled, a parasitic capacitance of a power transistor may be increased so much and transient characteristics such as an overshoot and an undershoot may become severe accordingly. However, an electronic device equipped with the linear power supply 1 can improve such transient characteristics.

Other Modifications

In addition to the above embodiments, the various technical features disclosed herein may be modified in different ways without departing from the gist of technical creation. For example, the exchange between a bipolar transistor and an MOSFET and a logical inversion of various signals are optional. In other words, the above embodiments are not limitative but illustrative in all respects.

Industrial Applicability

The linear power supply circuit disclosed herein can be used as power supply means for electronic devices equipped in a vehicle.

According to the present disclosure in some embodiments, it is possible to provide a linear power supply circuit with good transient characteristics.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A linear power supply circuit comprising:

a first output transistor of a P-channel type or pnp type which is connected between an input terminal to which an input voltage is input and an output terminal from which an output voltage is output;

a first differential amplifier configured to amplify a difference between the output voltage or a feedback voltage according to the output voltage and a predetermined first reference voltage and output a first amplification voltage;

a second differential amplifier configured to amplify a difference between the input voltage or a first monitor voltage according to the input voltage and the output voltage or a second monitor voltage according to the output voltage and output a second amplification voltage; and a first driver configured to generate a control voltage of the first output transistor according to the first amplification voltage and the second amplification voltage.

2. The linear power supply circuit of claim 1, further comprising:

a first voltage divider configured to divide the input voltage according to a first voltage division ratio and generate the first monitor voltage; and a second voltage divider configured to divide the output voltage according to a second voltage division ratio and generate the second monitor voltage.

3. The linear power supply circuit of claim 2, wherein the first voltage division ratio is designed to be equal to or lower than the second voltage division ratio.

4. A linear power supply circuit comprising:

a first output transistor of a P-channel type or pnp type which is connected between an input terminal to which an input voltage is input and an output terminal from which an output voltage is output;

a first differential amplifier configured to amplify a difference between the output voltage or a feedback voltage according to the output voltage and a predetermined first reference voltage and output a first amplification voltage;

a second differential amplifier configured to amplify a difference between the input voltage or a first monitor voltage according to the input voltage and the output voltage or a second monitor voltage according to the output voltage and output a second amplification voltage; and a first driver configured to generate a control voltage of the first output transistor according to the first amplification voltage and the second amplification voltage, wherein the first driver includes:

a first transistor of a pnp type or P-channel type, which is connected between the input terminal and a control terminal of the first output transistor, the first transistor having a conductance being changed by the first amplification voltage;

a second transistor of a pnp type or P-channel type, which is connected between the input terminal and the control terminal of the first output transistor, the second transistor having a conductance being changed by the second amplification voltage;

a current source connected between the control terminal of the first output transistor and a ground terminal; and a first resistor connected between the input terminal and the control terminal of the first output transistor.

5. A linear power supply circuit comprising:

a first output transistor of a P-channel type or pnp type which is connected between an input terminal to which an input voltage is input and an output terminal from which an output voltage is output;

a first differential amplifier configured to amplify a difference between the output voltage or a feedback voltage according to the output voltage and a predetermined first reference voltage and output a first amplification voltage;

a second differential amplifier configured to amplify a difference between the input voltage or a first monitor voltage according to the input voltage and the output voltage or a second monitor voltage according to the output voltage and output a second amplification voltage;

a first driver configured to generate a control voltage of the first output transistor according to the first amplification voltage and the second amplification voltage;

a second output transistor of an N-channel type or npn type which is connected between the input terminal and the output terminal;

a third differential amplifier configured to amplify a difference between the output voltage or the feedback voltage and a predetermined second reference voltage higher than the first reference voltage and output a third amplification voltage; and a second driver configured to generate a control voltage of the second output transistor according to the third amplification voltage.

6. The linear power supply circuit of claim 5, wherein the second driver includes:

a third transistor of an N-channel type or npn type, which is connected between a control terminal of the second output transistor and a ground terminal, the third transistor having a conductance being changed by the third amplification voltage; and a second resistor connected between the input terminal and the control terminal of the second output transistor.

7. A linear power supply circuit comprising:

a first output transistor of a P-channel type or pnp type which is connected between an input terminal to which an input voltage is input and an output terminal from which an output voltage is output;

a second output transistor of an N-channel type or npn type which is connected between the input terminal and the output terminal;

a first differential amplifier configured to amplify a difference between the output voltage or a feedback voltage according to the output voltage and a predetermined first reference voltage and output a first amplification voltage;

a second differential amplifier configured to amplify a difference between the output voltage or the feedback voltage and a predetermined second reference voltage higher than the first reference voltage and output a second amplification voltage;

a first driver configured to generate a control voltage of the first output transistor according to the first amplification voltage; and a second driver configured to generate a control voltage of the second output transistor according to the second amplification voltage.

8. A linear power supply circuit comprising:

a first output transistor of a P-channel type or pnp type which is connected between an input terminal to which an input voltage is input and an output terminal from which an output voltage is output;

a second output transistor of an N-channel type or npn type which is connected between the input terminal and the output terminal;

a first differential amplifier configured to amplify a difference between the output voltage or a feedback voltage according to the output voltage and a predetermined first reference voltage and output a first amplification voltage;

a second differential amplifier configured to amplify a difference between the output voltage or the feedback voltage and a predetermined second reference voltage higher than the first reference voltage and output a second amplification voltage;

a first driver configured to generate a control voltage of the first output transistor according to the first amplification voltage; and a second driver configured to generate a control voltage of the second output transistor according to the second amplification voltage, wherein the first driver includes:

a first transistor of a pnp type or P-channel type, which is connected between the input terminal and a control terminal of the first output transistor, the first transistor having a conductance being changed by the first amplification voltage;

a current source connected between the control terminal of the first output transistor and a ground terminal; and a first resistor connected between the input terminal and the control terminal of the first output transistor.

9. A linear power supply circuit comprising:

a first output transistor of a P-channel type or pnp type which is connected between an input terminal to which an input voltage is input and an output terminal from which an output voltage is output;

a second output transistor of an N-channel type or npn type which is connected between the input terminal and the output terminal;

a first differential amplifier configured to amplify a difference between the output voltage or a feedback voltage according to the output voltage and a predetermined first reference voltage and output a first amplification voltage;

a second differential amplifier configured to amplify a difference between the output voltage or the feedback voltage and a predetermined second reference voltage higher than the first reference voltage and output a second amplification voltage;

a first driver configured to generate a control voltage of the first output transistor according to the first amplification voltage; and a second driver configured to generate a control voltage of the second output transistor according to the second amplification voltage, wherein the second driver includes:

a second transistor of an N-channel type or npn type, which is connected between a control terminal of the second output transistor and a ground terminal, the second transistor having a conductance being changed by the second amplification voltage; and a second resistor connected between the input terminal and the control terminal of the second output transistor.

10. A linear power supply circuit comprising:

a first output transistor of a P-channel type or pnp type which is connected between an input terminal to which an input voltage is input and an output terminal from which an output voltage is output;

a second output transistor of an N-channel type or npn type which is connected between the input terminal and the output terminal;

a first differential amplifier configured to amplify a difference between the output voltage or a feedback voltage according to the output voltage and a predetermined first reference voltage and output a first amplification voltage;

a second differential amplifier configured to amplify a difference between the output voltage or the feedback voltage and a predetermined second reference voltage higher than the first reference voltage and output a second amplification voltage;

a first driver configured to generate a control voltage of the first output transistor according to the first amplification voltage;

a second driver configured to generate a control voltage of the second output transistor according to the second amplification voltage, and a reference voltage generator configured to divide a predetermined reference voltage and generate each of the first reference voltage and the second reference voltage.

11. The linear power supply circuit of claim 1, wherein the first driver includes:

a first transistor controlled by the first amplification voltage; and a second transistor controlled by the second amplification voltage, and wherein a control voltage of the first output transistor is generated based on the first transistor and the second transistor.

* * * * *